US012742371B1

(12) United States Patent
Batarseh

(10) Patent No.: US 12,742,371 B1
(45) Date of Patent: Sep. 22, 2026

(54) MULTI-STAGE PERFORATING

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/285,828

(22) Filed: Jul. 30, 2025

(51) Int. Cl.
*E21B 43/117* (2006.01)
*E21B 43/1185* (2006.01)

(52) U.S. Cl.
CPC ..... *E21B 43/1185* (2013.01); *E21B 43/117* (2013.01)

(58) Field of Classification Search
CPC ..... E21B 43/117; E21B 43/1185
See application file for complete search history.

(56) References Cited

U.S. PATENT DOCUMENTS

| | | | | |
|---|---|---|---|---|
| 2,587,723 | A | 3/1952 | Githens et al. | |
| 4,860,655 | A * | 8/1989 | Chawla | E21B 43/117 102/306 |
| 5,322,019 | A | 6/1994 | Hyland | |
| 5,408,556 | A | 4/1995 | Wong | |
| 5,479,860 | A | 1/1996 | Ellis | |
| 6,888,097 | B2 | 5/2005 | Batarseh | |
| 7,147,064 | B2 | 12/2006 | Batarseh et al. | |
| 8,511,401 | B2 | 8/2013 | Zediker et al. | |
| 8,826,973 | B2 | 9/2014 | Moxley et al. | |
| 9,140,856 | B2 | 9/2015 | Fomin et al. | |
| 9,932,803 | B2 | 4/2018 | Batarseh et al. | |
| 10,195,687 | B2 | 2/2019 | Land et al. | |
| 10,199,798 | B2 | 2/2019 | Faircloth et al. | |
| 10,620,387 | B2 | 4/2020 | Bushnell et al. | |
| 10,655,401 | B2 | 5/2020 | Azar et al. | |
| 10,907,456 | B2 | 2/2021 | Batarseh et al. | |
| 10,941,637 | B2 | 3/2021 | Skinner et al. | |
| 11,086,085 | B2 | 8/2021 | Morishima | |
| 11,149,499 | B1 | 10/2021 | Batarseh | |
| 11,163,091 | B2 | 11/2021 | Alabbad et al. | |

(Continued)

FOREIGN PATENT DOCUMENTS

| | | | |
|---|---|---|---|
| CN | 1224644 | A | 8/1999 |
| CN | 206662539 | U | 11/2017 |

(Continued)

OTHER PUBLICATIONS

Batarseh et al., "First Industrial High-Power Laser Perforation Deployment," Paper presented at the SPE Annual Technical Conference and Exhibition, San Antonio, Texas, USA, Oct. 2023, 2 pages.

(Continued)

*Primary Examiner* — David Carroll
(74) *Attorney, Agent, or Firm* — Fish & Richardson P.C.

(57) ABSTRACT

Systems and methods for forming perforations in a wellbore include: a laser source operable to generate a laser beam; a perforating gun with shaped charges of at least two different sizes, the perforating gun controllably rotatable relative to the wellbore when deployed; and a cable extending between the laser source and the perforating gun, the cable including at least one fiber optic cable to carry the laser beam from the laser source to the perforating gun.

19 Claims, 12 Drawing Sheets

(56) References Cited

U.S. PATENT DOCUMENTS

| | | | | |
|---|---|---|---|---|
| 11,168,546 | B2 | 11/2021 | Melhus et al. | |
| 11,220,876 | B1 | 1/2022 | Al Obaid | |
| 11,391,127 | B1 | 7/2022 | Hoelscher et al. | |
| 11,473,410 | B1 | 10/2022 | Batarseh | |
| 11,619,097 | B2 | 4/2023 | Batarseh et al. | |
| 11,644,630 | B2 | 5/2023 | Li et al. | |
| 11,739,616 | B1 | 8/2023 | Batarseh | |
| 11,846,164 | B2 | 12/2023 | Blois et al. | |
| 2007/0044672 | A1 | 3/2007 | Smith | |
| 2009/0205675 | A1 | 8/2009 | Sarkar et al. | |
| 2010/0269676 | A1* | 10/2010 | Behrmann | E21B 43/117 89/1.15 |
| 2011/0127028 | A1* | 6/2011 | Strickland | E21B 47/13 166/55.1 |
| 2013/0319984 | A1 | 12/2013 | Linyaev et al. | |
| 2014/0090846 | A1 | 4/2014 | Deutch et al. | |
| 2016/0251940 | A1 | 9/2016 | De Witt et al. | |
| 2018/0030334 | A1 | 2/2018 | Collier et al. | |
| 2018/0119530 | A1* | 5/2018 | Skinner | F42D 1/05 |
| 2018/0272467 | A1 | 9/2018 | Montaron et al. | |
| 2019/0032434 | A1 | 1/2019 | Batarseh | |
| 2019/0040726 | A1 | 2/2019 | Deutch et al. | |
| 2019/0264548 | A1* | 8/2019 | Zhao | E21B 43/119 |
| 2020/0094352 | A1 | 3/2020 | Batarseh et al. | |
| 2020/0115962 | A1 | 4/2020 | Batarseh | |
| 2021/0285294 | A1 | 9/2021 | Batarseh et al. | |
| 2021/0381316 | A1 | 12/2021 | Batarseh | |
| 2021/0396087 | A1 | 12/2021 | Tiwari et al. | |
| 2021/0404280 | A1 | 12/2021 | Al Obaid | |
| 2022/0056775 | A1 | 2/2022 | Al-Badran et al. | |
| 2022/0178218 | A1* | 6/2022 | Burky | E21B 43/117 |
| 2022/0178229 | A1* | 6/2022 | Alruwaili | E21B 43/117 |
| 2022/0314365 | A1 | 10/2022 | Johnson et al. | |
| 2022/0372822 | A1 | 11/2022 | Batarseh et al. | |
| 2023/0203923 | A1* | 6/2023 | Eitschberger | E21B 43/117 |
| 2023/0383626 | A1 | 11/2023 | Yang et al. | |
| 2024/0351139 | A1 | 10/2024 | Batarseh | |

FOREIGN PATENT DOCUMENTS

| | | | |
|---|---|---|---|
| CN | 116591865 | A | 8/2023 |
| EP | 4226018 | B1 | 9/2024 |
| EP | 4370772 | B1 | 3/2025 |
| WO | WO 2022122742 | A2 | 6/2022 |
| WO | WO 2023211741 | A1 | 11/2023 |

OTHER PUBLICATIONS

Batarseh et al., "Well Perforation Using High-Power Lasers," Paper presented at the SPE Annual Technical Conference and Exhibition, Denver, Colorado, Oct. 2003, Abstract Only, 2 pages.

International Search Report and Written Opinion in Intl. Appln. No. PCT/US2025/043975, mailed on Feb. 3, 2026, 15 pages.

International Search Report and Written Opinion in Intl. Appln. No. PCT/US2025/044644, mailed on Apr. 7, 2026, 17 pages.

* cited by examiner

MULTI-STAGE PERFORATING

TECHNICAL FIELD

This specification generally relates to perforating wellbores, particularly performing multi-stage perforation of wellbores.

BACKGROUND

An oil well is a drillhole boring in Earth that is designed to bring petroleum oil hydrocarbons to the surface. Usually some natural gas is released as associated petroleum gas along with the oil. A well that is designed to produce only gas may be termed a gas well. Wells are created by drilling down into an oil or gas reserve and, if necessary, equipped with extraction devices such as pumpjacks. Creating the wells can be an expensive process, costing at least hundreds of thousands of dollars, and costing much more when in difficult-to-access locations, e.g., offshore. The process of modern drilling for wells first started in the 19th century but was made more efficient with advances to oil drilling rigs and technology during the 20th century.

Fracturing (also known as hydraulic fracturing, fracking, hydrofracturing, or hydrofracturing) is a technique used to extract oil and natural gas from deep underground rock formations, particularly shale. This well stimulation technique involves the fracturing of formations in bedrock by a pressurized liquid. The process involves the high-pressure injection of "fracturing fluid" (primarily water, containing sand or other proppants suspended with the aid of thickening agents) into a wellbore to create cracks in the deep-rock formations through which natural gas, petroleum, and brine will flow more freely. When the hydraulic pressure is removed from the well, small grains of proppants can hold the fractures open.

Well perforation is frequently performed as part of well completion or fracturing. Well perforation tools, such as shaped perforating charges, bullet guns, and abrasive jets, can be used to create a hole or holes (i.e., perforations) through walls and casing(s) of a wellbore. The perforations can provide a channel between an oil or gas reservoir and the wellbore to allow formation fluids to easily flow into the wellbore. For example, a wellbore can be drilled down past the section of the formation desired for production and have casing or a liner run in separating the formation from the well bore. After the casing or liner is installed, a well perforation tool can be run in to a production and operated to perforate the casing or liner.

SUMMARY

This specification describes an approach to perforating wellbores that can create and extend tunnels through wellbores into the surrounding formations. This approach uses a downhole tool with multiple shaped charges of different sizes that can be used to penetrate the same hole. The tool can include a laser source operable to trigger explosives (e.g., explosives enhanced with enablers). The enablers are materials that heat up quickly on interaction with the laser beam. Examples of enablers include activated carbon and other materials that heat up rapidly when exposed to laser or electromagnetic waves. The laser source can be deployed at the surface with fiber optics connecting the laser source to a downhole portion of the tool.

The approach disclosed in this specification can provide one or more of the following advantages. This approach be used to creating deeper tunnels of different sizes or the same size than those formed by shaped charge perforation using single size pre-loaded shaped charges in a perforation gun. Including enablers in the explosives can enhance the force generated by the tool. Using a laser source to trigger the explosives can reduce the risk of misfiring. Carrying multiple charges on a single tool can provide operational efficiency by reducing the need to trip in and out of the wellbore.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

This specification describes an approach to perforating wellbores that can create and extend tunnels through wellbores into the surrounding formations. This approach uses a downhole tool with multiple shaped charges of different sizes that can be used to penetrate the same hole. The tool can include a laser source operable to trigger explosives (e.g., explosives enhanced with enablers). The enablers are materials that heat up quickly on interaction with the laser beam. Examples of enablers include activated carbon and other materials that heat up rapidly when exposed to laser or electromagnetic waves. The laser source can be deployed at the surface with fiber optics connecting the laser source to a downhole portion of the tool.

Figure 1A:
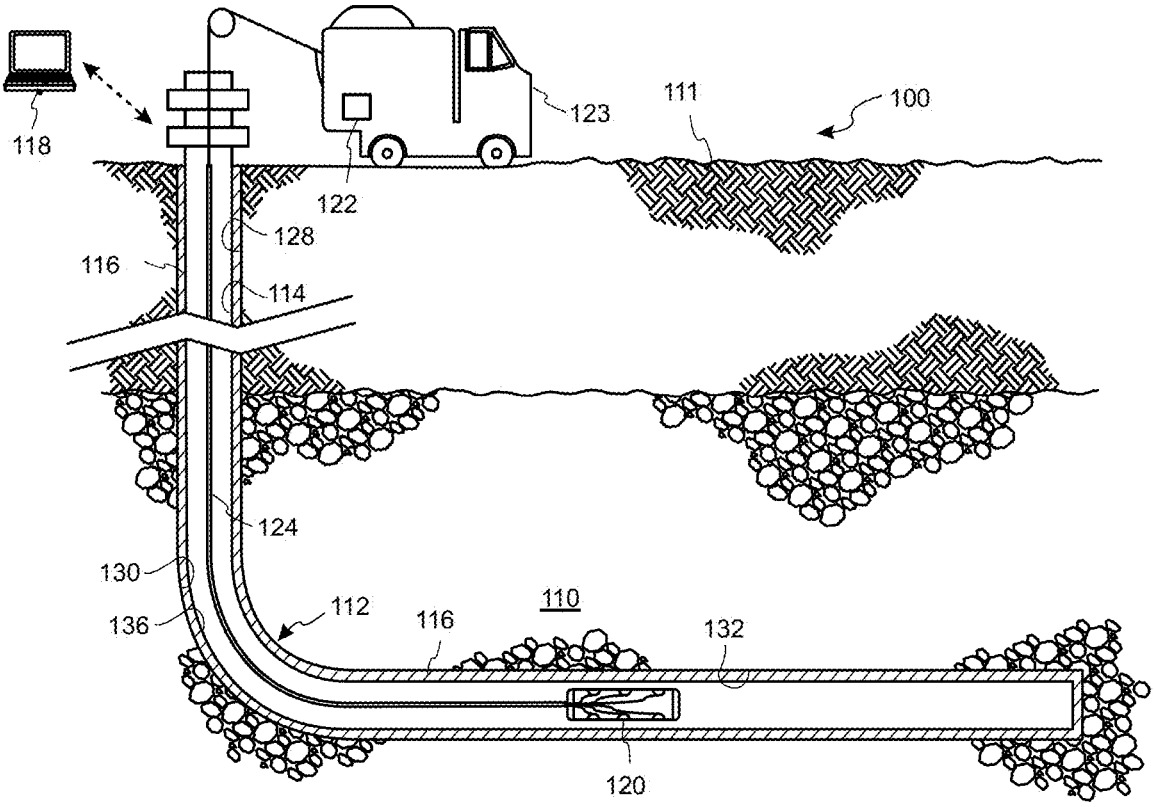
FIGS. 1A-1C are schematic diagrams of a wellbore system extending into a subsurface formation illustrating perforation of the wellbore system using a downhole tool.
Figure 1B:
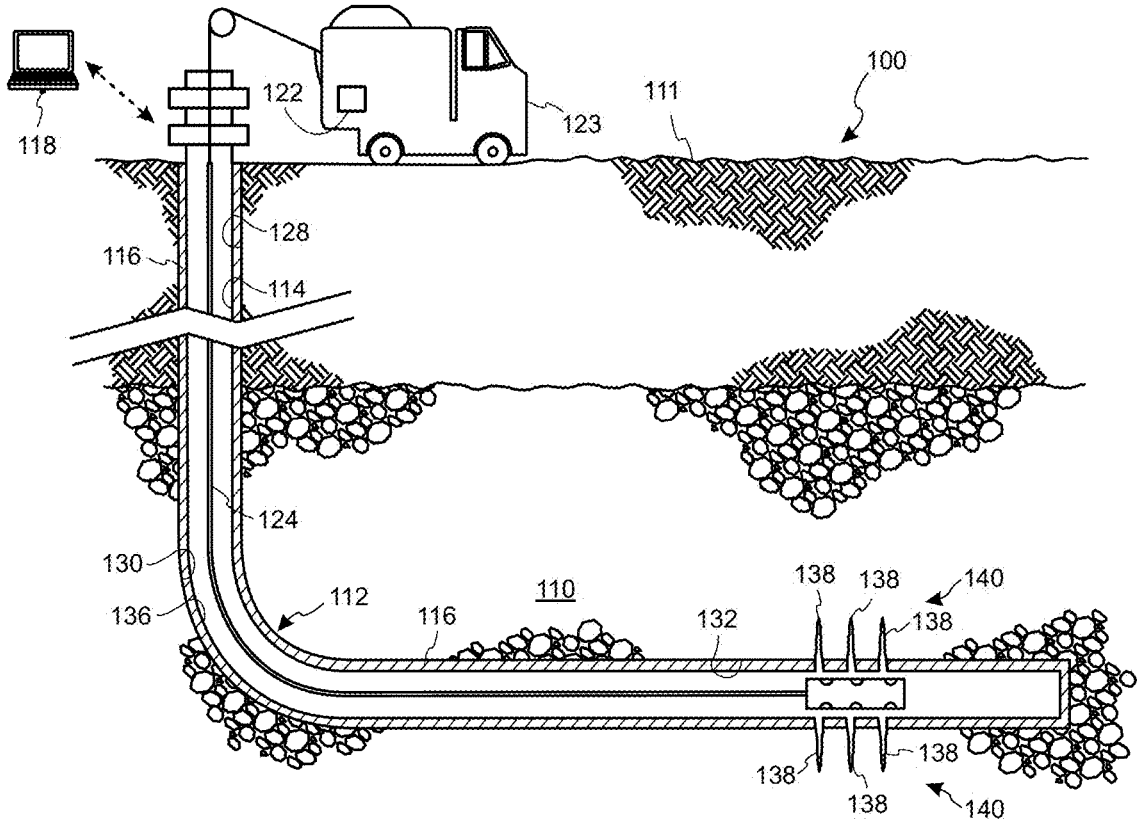
Figure 1C:
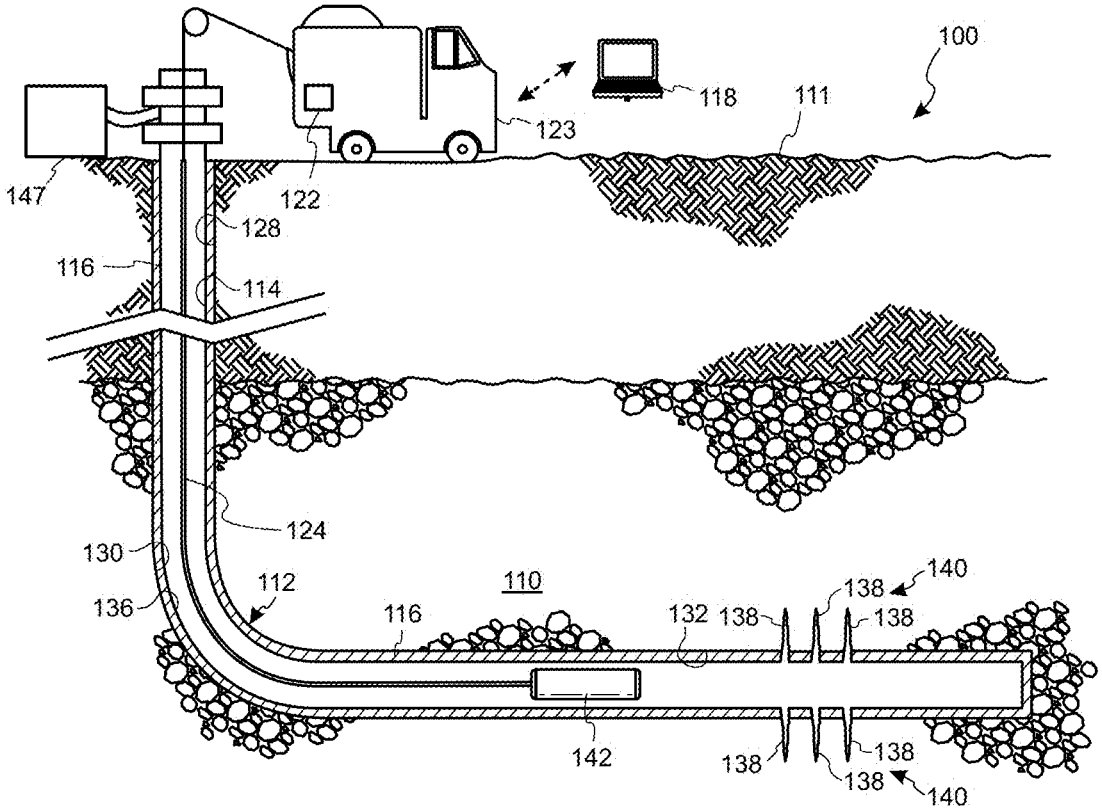
Figure 2A:
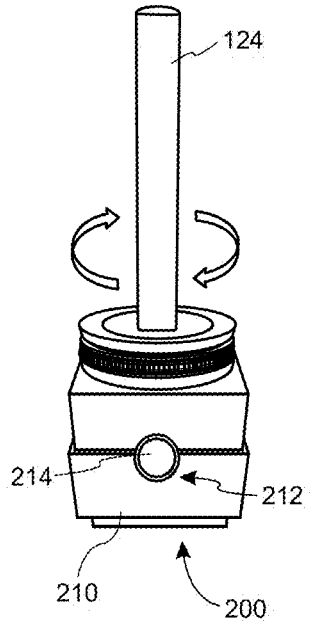
FIGS. 2A-2D are perspective views of a perforation gun with four sides with different sized charges installed in each side.
Figure 2B:
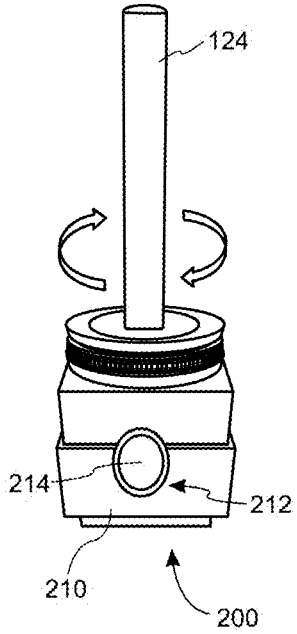
Figure 2C:
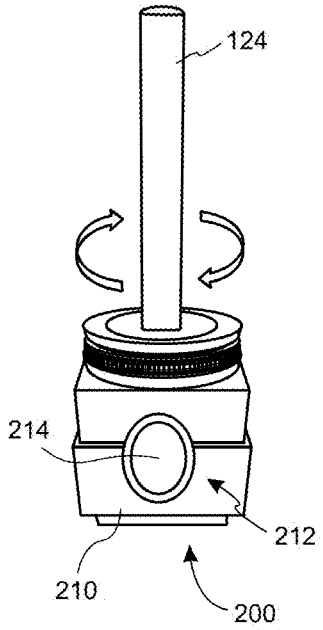
Figure 2D:
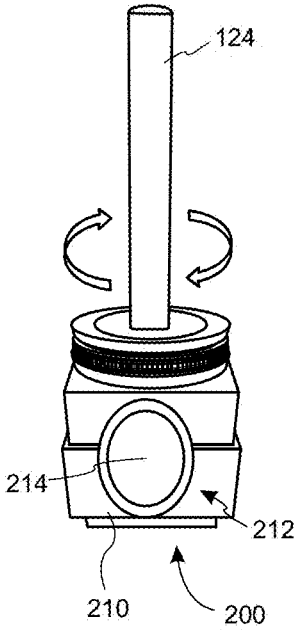

FIGS. 1A-1C are schematic diagrams of a wellbore system 100 extending into a subsurface formation 110 from ground surface 111. The wellbore system 100 includes a borehole 112, a surface casing 114, cement 116, and a control system 118. FIG. 1A illustrates a perforating gun 120 being run in the wellbore system 100. FIG. 1B illustrates the wellbore system 100 after the perforating gun 120 is used to perforate the surface casing 114 and the cement 116. FIG. 1C illustrates the wellbore system 100 during fracturing operations The perforating gun 120 provides an integrated tool that combines high laser energy with enablers in a tool that can hold different sizes of charges. The perforating gun can be controllably rotated. The controllable rotation enables the perforating gun 120 to form perforations at desired orientations relative to the wellbore system 100. The controllable rotation also enables the perforating gun 120 to easily fire multiple shots into a single hole.

The perforating gun 120 can be deployed on a wireline 124 extending from a surface unit 123 with a laser source 122. The wireline 124 includes fiber optics extending from the laser source 122 to the perforating gun 120. This connectivity enables the laser source 122 to be used selectively trigger individual shaped charges. In the illustrated perforating gun 120, individual fiber optic cables extend to individual shaped charges. Some perforating guns include a single fiber optic cable connecting the laser source 122 to the perforating gun where laser energy is selectively directed to individual charges. Some systems use coiled tubing or slickline technologies to deploy the perforating gun and attached cable into wellbore.

The borehole 112 is a directional borehole that includes a substantially vertical portion 128 coupled to a radiused or curved portion 130, which in turn is coupled to a substantially horizontal portion 132. The three portions of the borehole 112—the vertical portion 128, the curved portion 130, and the horizontal portion 132—form a continuous borehole that extends into the Earth.

As used in the present disclosure, "substantially" in the context of a borehole orientation, refers to boreholes that may not be exactly vertical (for example, exactly perpendicular to the ground surface 111) or exactly horizontal (for example, exactly parallel to the ground surface 111). In some cases, the borehole 112 is inclined relative to the ground surface 111. In other words, those of ordinary skill in the drill arts would recognize that vertical boreholes often undulate offset from a true vertical direction that they might be drilled at an angle that deviates from true vertical, and horizontal boreholes often undulate offset from a true horizontal direction. Further, the substantially horizontal portion 126, in some aspects, may be a slant borehole or other directional borehole that is oriented between exactly vertical and exactly horizontal. The substantially horizontal portion 126, in some aspects, may be oriented to follow a slant of the formation. At least a portion of the borehole 112, such as the curved portion 130 and the horizontal portion 132, may be considered an inclined or deviated borehole, in other words, a non-vertical borehole.

The surface casing 114 of the borehole 112 is positioned and set around the borehole 112 from the ground surface 111 into a particular depth in the Earth. For example, the surface casing 114 may be a relatively large-diameter tubular member (or string of members) set (for example, cemented) in the borehole 112 in a shallow formation. As used herein, "tubular" may refer to a member that has a circular cross-section, elliptical cross-section, or other shaped cross-section. As illustrated, a production casing 136 is positioned and set within the borehole 112 downhole of the surface casing 114. Although termed a "production" casing, in this example, the production casing 136 may or may not have been subject to hydrocarbon production operations. Thus, the production casing 136 refers to and includes any form of tubular member that is set (for example, cemented) in the borehole 112 downhole of the surface casing 114. In some examples of the wellbore system 100, the production casing 136 may begin at an end of the curved portion 130 and extend throughout the substantially horizontal portion 126. The production casing 136 could also extend into the curved portion 130 and into the vertical portion 128.

Cement 116 is positioned (for example, pumped) around the surface casing 114 and production casing 136 in an annulus between the surface casing 114 and production casing 136 and the borehole 112. The cement 116, for example, may secure the surface casing 114 and production casing 136 (and any other casings or liners of the borehole 112) through the subsurface layers under the ground surface 111. In some aspects, the cement 116 may be installed along the entire length of the casings (for example, surface casing 114 and production casing 136 and any other casings), or the cement 116 could be used along certain portions of the casings if adequate for the particular borehole. Other casings, such as conductor casings or intermediate casings, can be used in the wellbore system 100.

The borehole 112 extends through one or more subsurface layers (not specifically labeled) and lands in subsurface formation 110. The subsurface formation 110, in this example, may be chosen as the landing for the substantially horizontal portion 126, for example, in order to initiate completion operations such as hydraulic fracturing operations and ultimately recover hydrocarbon fluids from the subsurface formation 110. In some examples, the subsurface formation 110 is composed of shale or tight sandstone. Shale, in some examples, may be source rocks that provide for hydrocarbon recovery from the subsurface formation 110.

Referring to FIG. 1B, the borehole 112 includes one or more perforation channels 138 that radially extend from the borehole 112. The illustrated perforation channels 138 extend through the production casing 136 and the cement 116, and into the subsurface formation 110. The perforation channels 138 are formed by firing the shape charges of the perforating gun 120 after the perforating gun 120 has been run in to the desired location. In some examples, the one or more perforation channels 138 are the borehole segments. Generally, a borehole segment is length segment of the borehole where fracturing operations are desired. In some examples, the borehole segment is some of the perforation channels 138. In some examples, the borehole segment is an end segment 140 of the borehole 112.

In some examples, the perforation channels 138 are formed by, for example, shaped explosive charges, water jetting, laser, or other conventional perforating techniques. In some aspects, multiple perforation channels 138 may include a perforation stage. Each perforation channels 138, as well as each perforation cluster, may provide a path (or paths) for a hydraulic fracturing liquid (with or without proppant) to enter the subsurface formation 110 from the borehole 112 in order to initiate and propagate hydraulic fractures (extending from the perforation channels 138) through the subsurface formation 110. In some examples, the perforation channels 138 and/or the borehole 112 contains mud.

Referring to FIG. 1C, the wellbore system 100 includes a well log instrument 142 communicably coupled to a downhole conveyance 124, such as a wireline, optical line, or other data communication cable. The downhole conveyance 144 provides data from the well log instrument 142 to the control system 118, for real time (for example, during logging operations) or later usage in measuring one or more properties of the borehole 112 or the surrounding formation.

In some examples, the data from the well log instrument 142 represents geometric data associated with a borehole segment of the borehole 112 and includes information regarding a length of the borehole segment, a radius of the borehole segment, an inclination angle of the borehole segment, and/or an azimuth angle of the borehole segment.

In some examples, the data from the well log instrument 142 represents information identifying a rock of the subsurface formation 110. In some examples, the data represents information about a permeability of the rock. In some examples, the data from the well log instrument 142 represents information about a thickness of filter cake within and/or surrounding the borehole segment. In some examples, the data represents information about a permeability of the filter cake. In some examples, the data from the well log instrument 142 represents information about in-situ stresses and/or pore pressures within and/or surrounding the borehole segment.

In some examples, the control system 118 includes a microprocessor based control system that includes, for example, one or more hardware processors, one or more memory storage devices (for example, tangible, non-transitory computer-readable memory modules), one or more network interfaces, and one or more input/output devices, including, for example, a graphical user interface (GUI) to present one or more determinations or data from the computer framework for predicting the breakdown pressure of the subsurface formation 110.

In some examples, the control system 118 implements computer software to determine the breakdown pressure associated with one or more borehole segments of the borehole 112. For example, the one or more of the perforation channels 138 of the borehole 112 or the end segment 140 of the borehole 112. In some examples, the control system 118 is located on-site at the borehole 112. For example, the control system 118 can be located within an on-site building, trailer, or vehicle. In some examples, the control system 118 is located off-site from the borehole 112. For example, the control system 118 can be located at a remote data center or an engineering facility.

The wellbore system 100 includes a hydraulic pump 147 operable to pump a fluid into the borehole 112 to fracture the borehole segment. The hydraulic pump 147 pumps fluid into the borehole 112 with a pressure approximately equal to the predicted breakdown pressure to fracture the subsurface formation 110 surrounding the borehole segment. The control system 118 controls the hydraulic pump 147 to pump the hydraulic fluid into the borehole 112 and into the borehole segment.

FIGS. 2A-2D are perspective views of a perforation gun 200 with four sides with different sized charges installed in each side. Each figure represents a quarter turn from the previous figure with each figure showing a different side of the perforation gun 200.

The perforation gun 200 has a body 210 with the slot 212 in each side of the body 210. A shaped charge 214 is mounted in each slot 212. Different sized slots are used to accommodate different size charges. The perforation gun 200 is deployed on wireline 124. The perforation gun can be controlled from the surface using, for example, a downhole gear, rotational joints or motors.

In some systems, the shaped charges include explosives mixed with an enabler. Enablers can be material that heats up to at least 888° C. within 3 seconds when contacted with a laser beam. The enabler provides an increase in temperature that enhances and speeds the explosion reaction in the tool enhancing the efficiency of the penetration, by providing more penetration energy.

Figure 3:
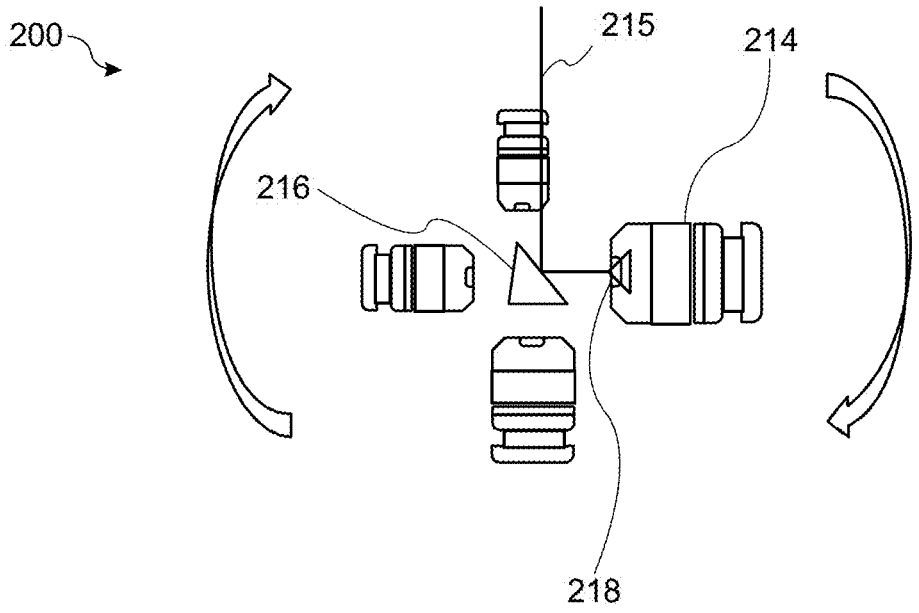
FIGS. 3 and 4 are schematic drawings illustrating the relative position of the charges in perforating guns.
Figure 4:
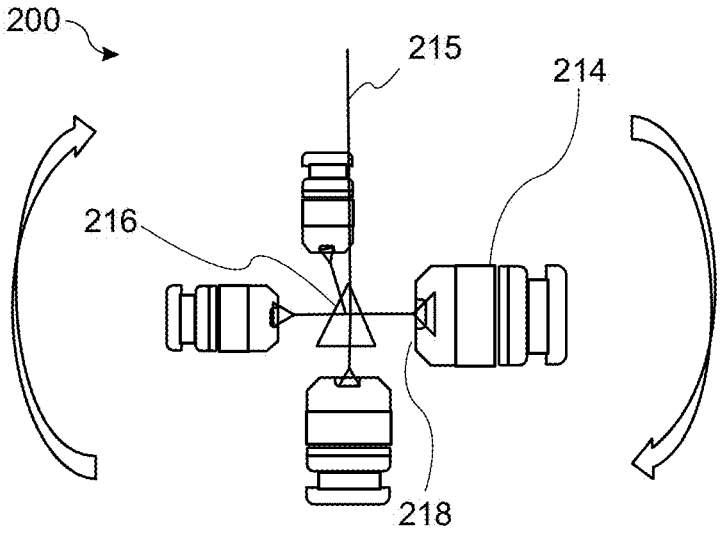
Figure 5A:
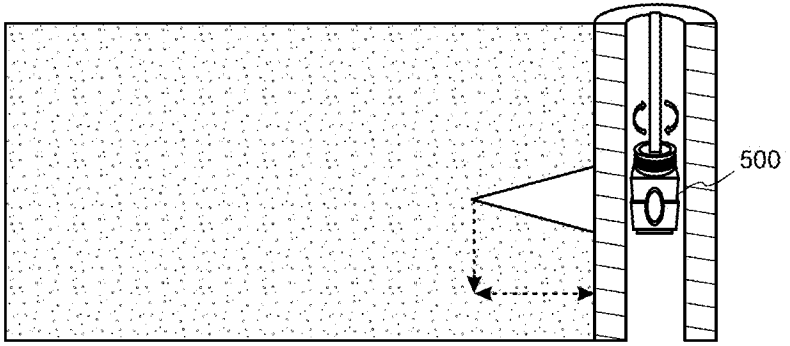
FIGS. 5A-5D are schematic drawings illustrating operation of a perforating gun with multiple different size charges.
Figure 5B:
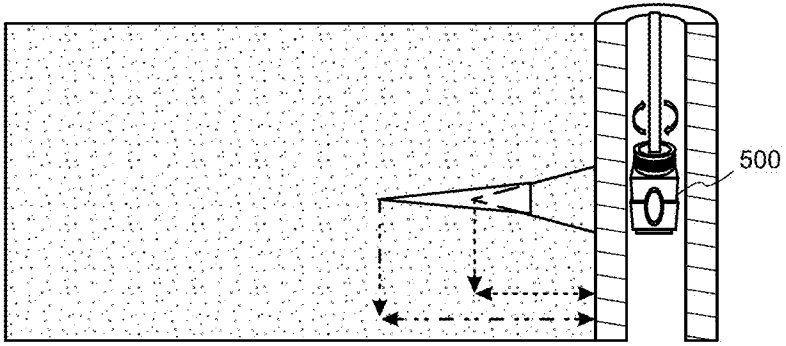
Figure 5C:
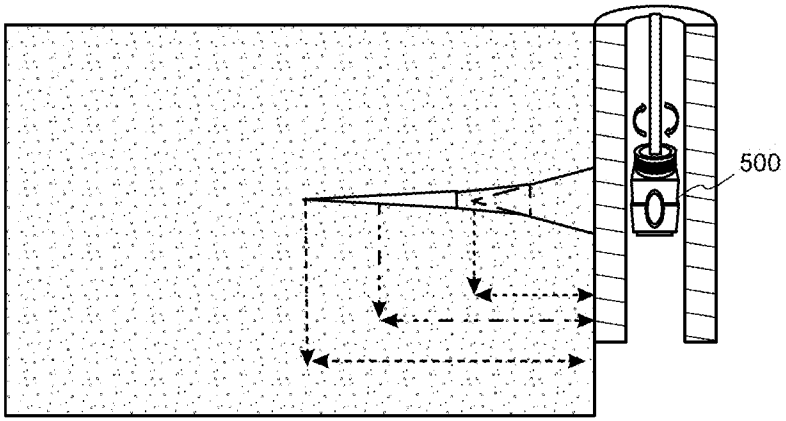
Figure 5D:
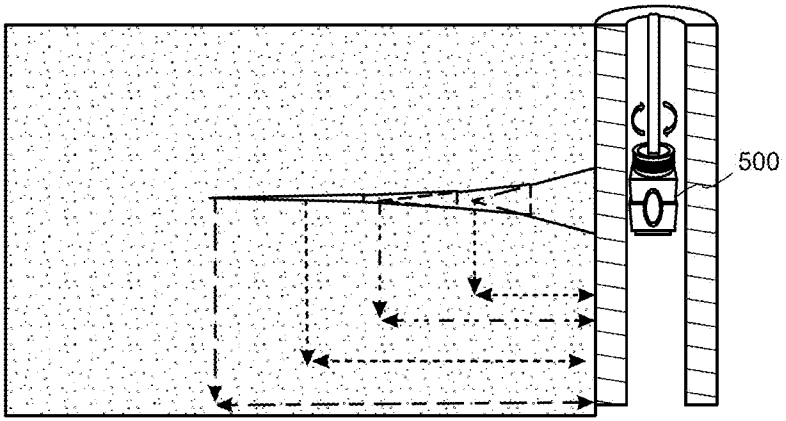

FIGS. 3 and 4 are schematic drawings illustrating the relative position of the charges 214 in perforating guns 200 and two approaches to coupling the laser source shown in FIGS. 1A-1C to the shaped charges 214. As previously described with reference to FIGS. 1A-1C, the perforating gun 126 had individual fiber optic cables extending between the laser source and individual shaped charges. In contrast, the perforating gun 200 has a single fiber optic cable extending between the laser source and directing a laser beam 215 to an optical component 216 of the perforating gun 200. For example, the optical component can be a rotational reflector as shown in FIG. 3, a splitter as shown in FIG. 4, or other mirrors, prisms, or lenses. For example, splitters can be used when there are different slots or charges aligned in 2 or more directions (e.g., 4 directions as illustrated in FIG. 4).

The shaped charges 214 include lenses 218 that that transform and reshape the laser beam from the fiber optics cable and the optical component 260. The lenses 218 focus the laser to increase its intensity. When the focused laser beam contacts the mixture of the explosives with the enablers, the laser beam triggers an explosion and forming a perforation into the formation.

Figure 6:
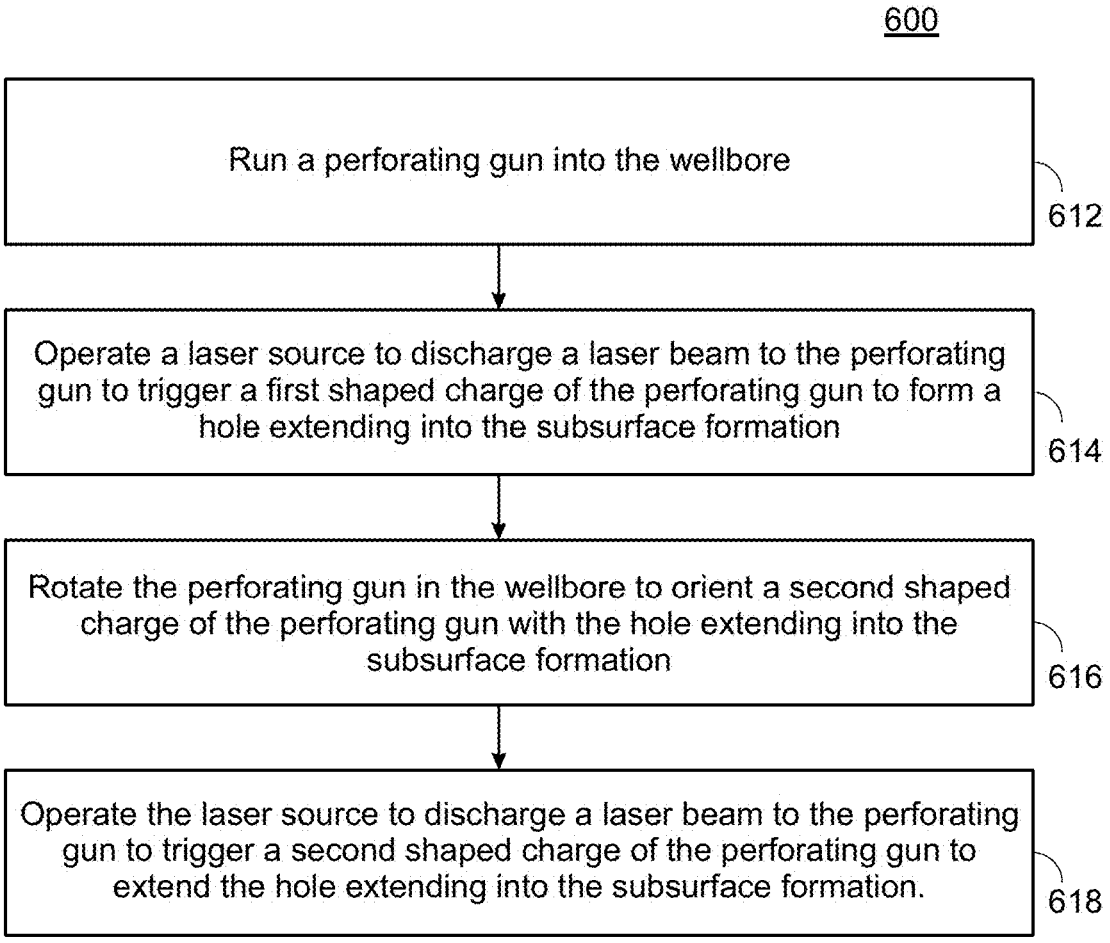
FIG. 6 is a flowchart of a method the perforating a wellbore.

FIGS. 5A-5D are schematic drawings illustrating operation of a perforating gun with multiple different size charges. FIG. 6 is a flowchart of a method 600 for the perforating a wellbore.

A perforating gun 500 (e.g. any of the previously described perforating guns) is run into the wellbore to the location where formation of perforations is desired (step 612). As illustrated, the perforating gun is run into the wellbore on a wireline comprising at least one fiber optic cable. As previously discussed, other methods of deploying the perforating gun can be used. A laser source is operated to discharge a laser beam to the perforating gun to trigger a first shaped charge of the perforating gun to form a hole extending into the subsurface formation (step 614).

The perforating gun is rotated in the wellbore to orient a second shaped charge of the perforating gun with the hole extending into the subsurface formation (step 616). The laser source is then operated to discharge a laser beam to the perforating gun to trigger a second shaped charge of the perforating gun to extend the hole extending into the subsurface formation (step 618). In the illustrated sequence of operations, the largest shaped charge is triggered first and incrementally smaller charges are used with each step. In some situations, other sequences of operations are used.

Figure 7:
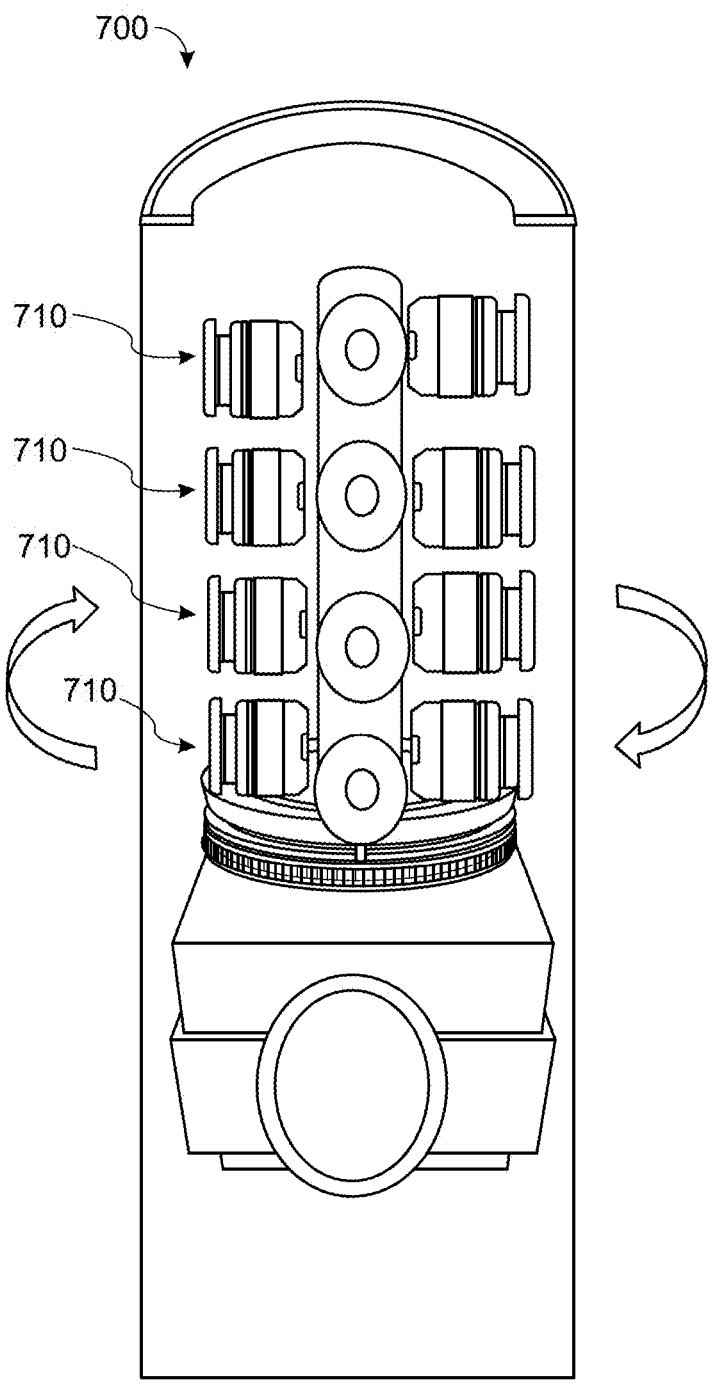
FIG. 7 is a schematic drawing illustrating a perforating gun with stacked charges.

FIG. 7 is a schematic drawing illustrating a perforating gun 700 with stacked arrays 710 of shaped charges. Each of the arrays 710 of shaped charges can be configured in the various ways the shaped charges were in the previously described perforating guns. For example, each array 710 of stacked charges can include multiple different sizes of shaped charges. The individual shaped charges can be connected to a laser source by individual fiber optic cables or a single cable can be used with an optical component in the perforating gun controlling the direction of the laser beam after it reaches the perforating gun.

Figure 8:
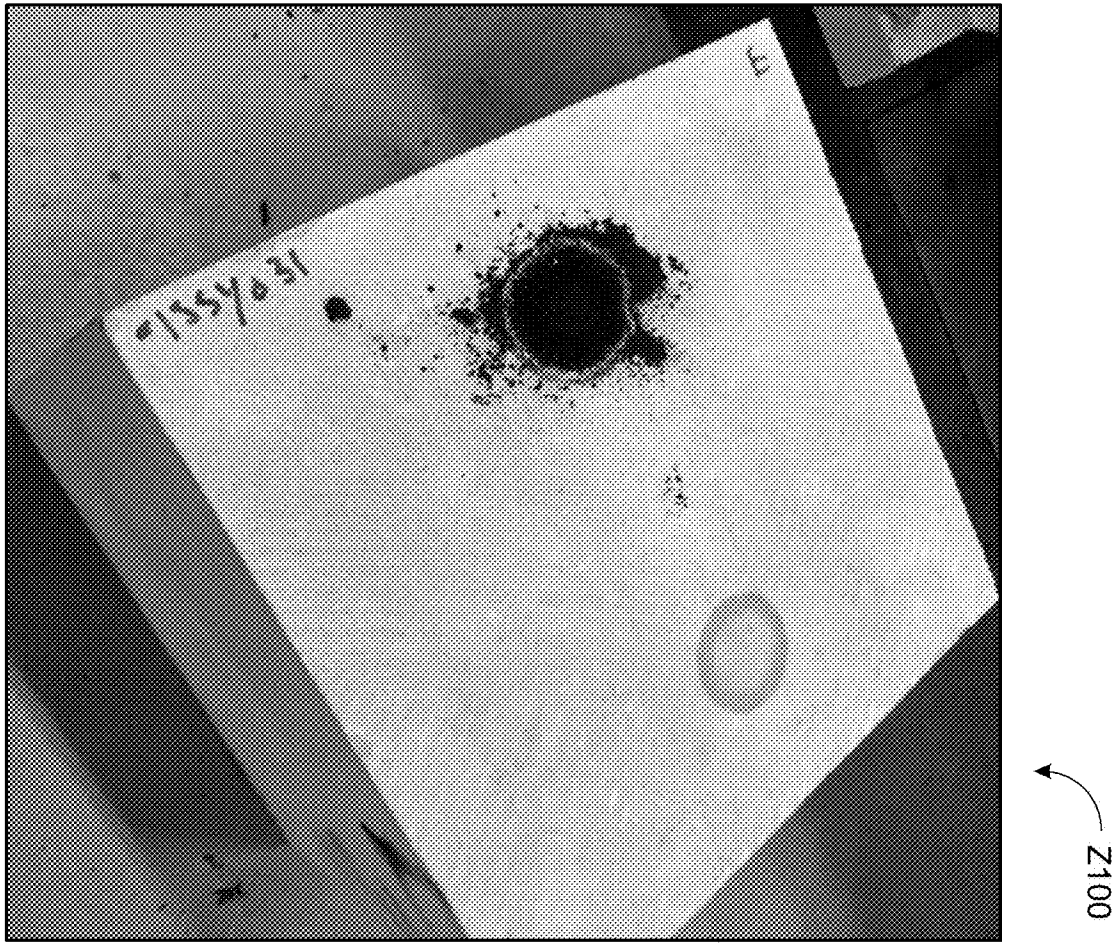
FIG. 8 is a photograph showing the results of a test comparing laser heating with enablers to laser heating without enablers.
Figure 9A:
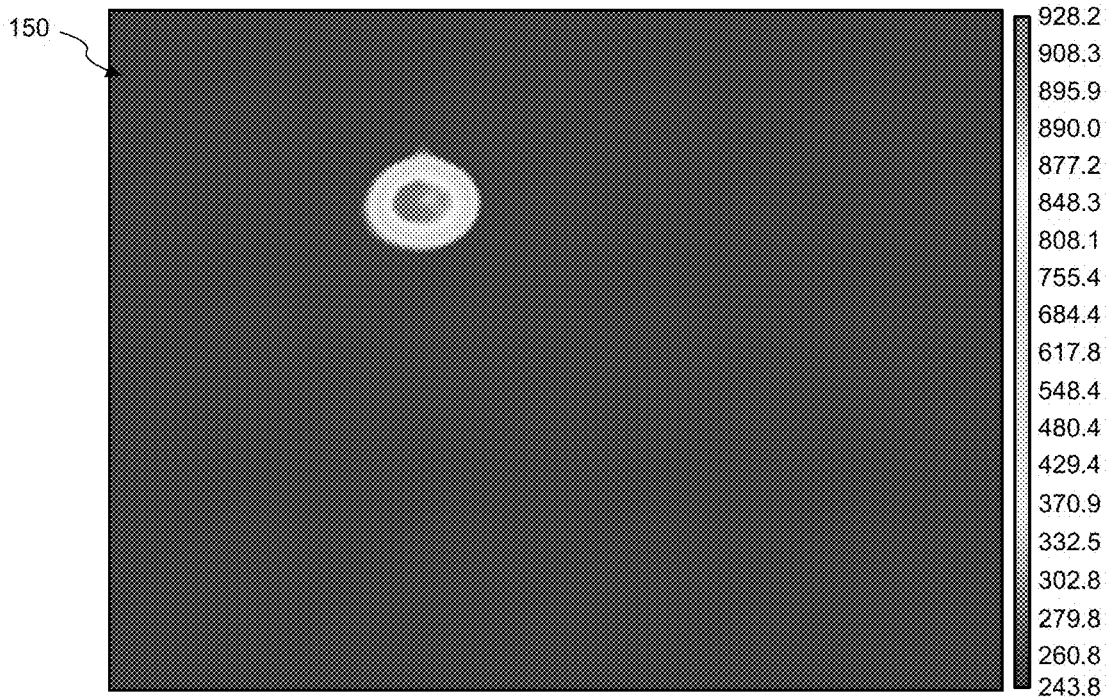
FIGS. 9A and 9B are plots comparing the size and temperature generated by the laser heating.
Figure 9B:
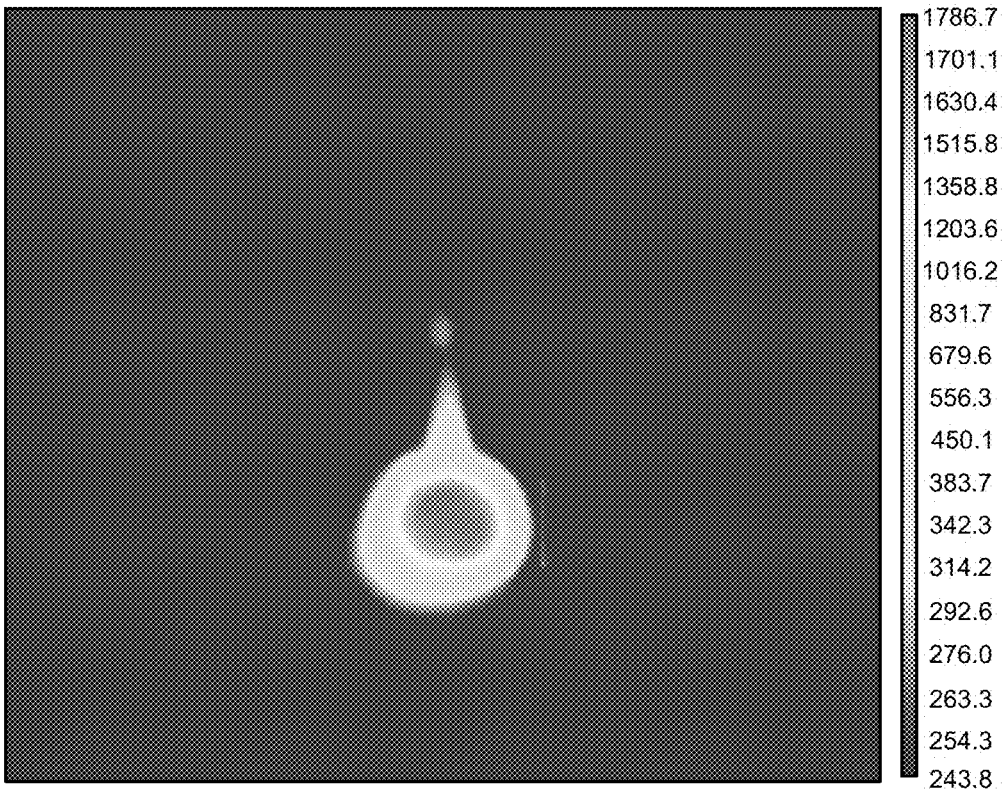
Figure 10A:
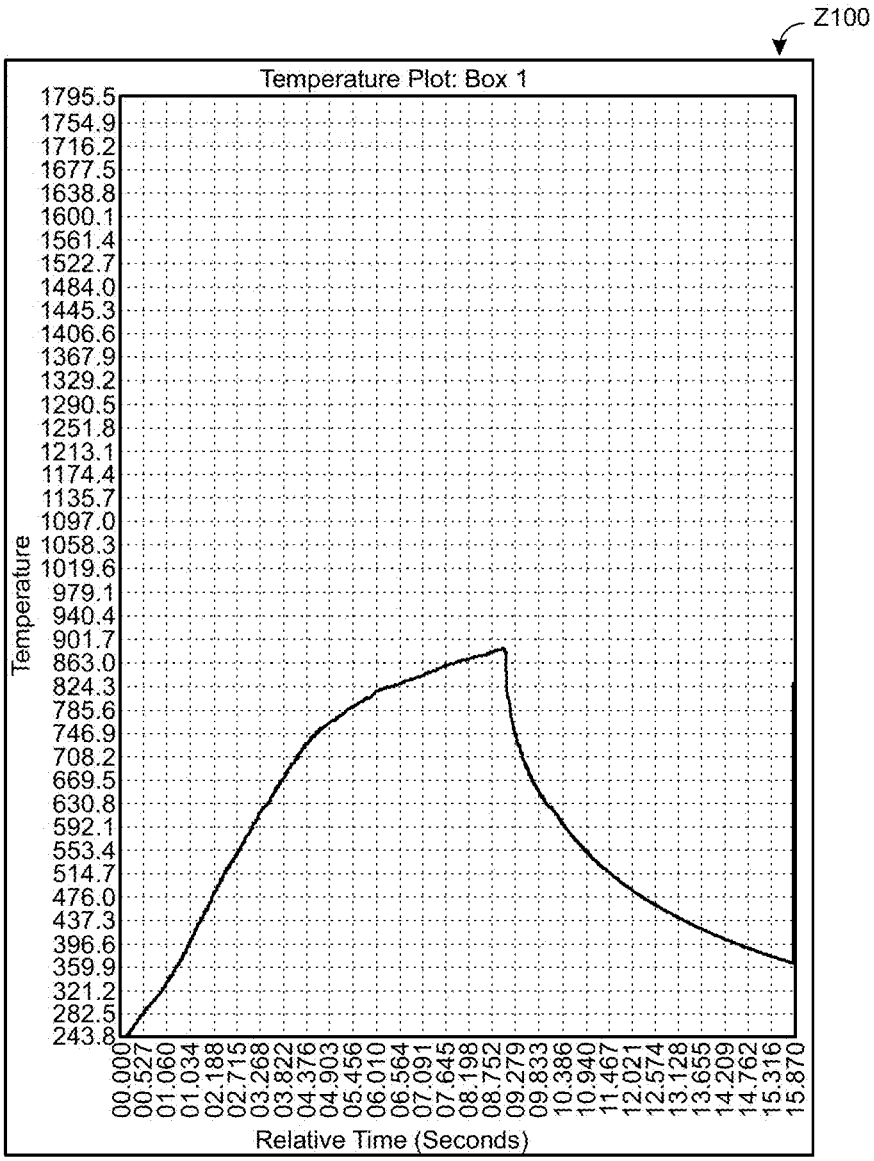
FIGS. 10A and 10B are charts comparing the temperatures generated by the laser heating.
Figure 10B:
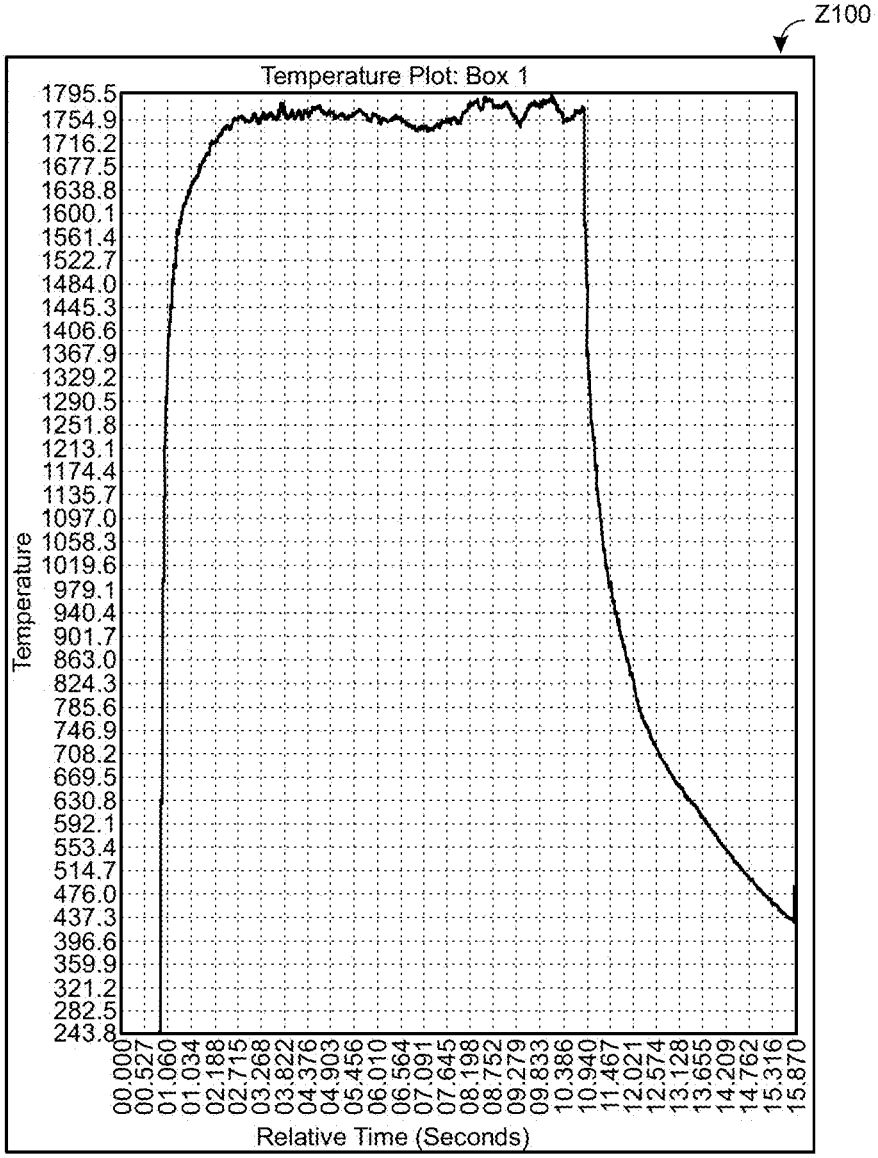

FIG. 8 is a photograph showing the results of a test comparing laser heating with enablers to a laser heating without enablers. FIGS. 9A and 9B are plots comparing the size and temperature generated by the laser heating. FIGS. 10A and 10B are charts comparing the temperatures generated by the laser heating.

The test provided a proof of concept of using enablers as triggers with the explosives. As shown in FIG. 7, the test was conducted on a block of limestone. Activated carbon (AC) was used as the enable and applied to cover one area of the block surface. A 1 kW laser beam was applied emitted on the rock with an infrared (IR) camera capturing the temperature of the heated spot with a heating duration of 30 seconds. The maximum temperature reached the core sample without activated carbon recorded by the IR camera (FIG. 5) and is presented in FIG. 6 for the same rock to be 888 C. The laser moved to the area which is covered with activated carbon, and heat up the for the same amount of time (30 seconds), FIG. 7 presents the IR image of the laser on the activated carbon. The value recorded in presented in FIG. 7, reaches 1795° C.

EXAMPLES

In some implementations, systems for forming perforations in a wellbore include: a laser source operable to generate a laser beam; a perforating gun controllably rotatable relative to the wellbore when deployed, the perforating gun comprising stacked arrays of shaped charges, each array of stacked charges comprising at least four different sizes shaped charges; and a cable extending between the laser source and the perforating gun, the cable including at least one fiber optic cable to carry the laser beam from the laser source to the perforating gun.

In an example implementation combinable with any other example implementation, systems further include a gear, motor, and/or rotational joint operable to rotate the perforating gun when deployed.

In an example implementation combinable with any other example implementation, each shaped charge comprises an explosive and a material heats up to at least 888° C. within 3 seconds.

In an example implementation combinable with any other example implementation, the at least one fiber optic cable includes individual fiber optic attached individual shaped charges.

In an example implementation combinable with any other example implementation, the at least one fiber optic cable is a single fiber optic cable extending from the laser source to an optical component of the perforating gun. In some cases, the optical component of the perforating gun comprises a rotational reflector or a splitter.

In some implementations, systems for forming perforations in a wellbore, include: a laser source operable to generate a laser beam; a perforating gun with shaped charges of at least two different sizes, the perforating gun controllably rotatable relative to the wellbore when deployed; and a cable extending between the laser source and the perforating gun, the cable including at least one fiber optic cable to carry the laser beam from the laser source to the perforating gun.

In an example implementation combinable with any other example implementation, the shaped charges of at least two different sizes comprise four shaped charges of different sizes. In some cases, the shaped charges of at least two different sizes comprise stacked arrays, each array comprising four shaped charges of different sizes. In some cases, the systems also include a gear, motor, and/or rotational joint operable to rotate the perforating gun when deployed.

In an example implementation combinable with any other example implementation, each shaped charge comprises an explosive and a material heats up to at least 888° C. within 3 seconds.

In an example implementation combinable with any other example implementation, the at least one fiber optic cable includes individual fiber optic attached individual shaped charges.

In an example implementation combinable with any other example implementation, the at least one fiber optic cable is a single fiber optic cable extending from the laser source to an optical component of the perforating gun.

In some implementations, methods of forming perforations in a wellbore in a subsurface formation include: running a perforating gun into the wellbore; operating a laser source to discharge a laser beam to the perforating gun to trigger a first shaped charge of the perforating gun to form a hole extending into the subsurface formation; rotating the perforating gun in the wellbore to orient a second shaped charge of the perforating gun with the hole extending into the subsurface formation; and operating the laser source to discharge a laser beam to the perforating gun to trigger a second shaped charge of the perforating gun to extend the hole extending into the subsurface formation.

In an example implementation combinable with any other example implementation, running the perforating gun into the wellbore comprises running the perforating gun into the wellbore on a cable comprising at least one fiber optic cable. In some methods, operating the laser source to discharge the laser beam to the perforating gun to trigger the first shaped charge comprises discharging the laser beam into the at least one fiber optic cable. In some methods, the at least one fiber optic cable includes individual fiber optic cables attached individual shaped charges. In some methods, the at least one fiber optic cable is a single fiber optic cable extending from the laser source to an optical component of the perforating gun. In some methods, the optical component of the perforating gun includes a rotational reflector or a splitter.

In an example implementation combinable with any other example implementation, the second shaped charge is smaller than the first shaped charge.

A number of embodiments of the systems and methods have been described. Nevertheless, it will be understood that various modifications may be made without departing from the spirit and scope of this specification. Accordingly, other embodiments are within the scope of the following claims.

What is claimed is:

1. A system for forming perforations in a wellbore, the system comprising:

a laser source operable to generate a laser beam;

a perforating gun controllably rotatable relative to the wellbore when deployed, the perforating gun comprising stacked arrays of shaped charges, each array of stacked charges comprising at least four different sizes shaped charges; and a cable extending between the laser source and the perforating gun, the cable including at least one fiber optic cable to carry the laser beam from the laser source to the perforating gun.

2. The system of claim 1, further comprising a gear, motor, and/or rotational joint operable to rotate the perforating gun when deployed.

3. The system of claim 1, wherein each shaped charge comprises an explosive and a material that heats up to at least 888° C. within 3 seconds when contacted with a laser beam.

4. The system of claim 1, wherein the at least one fiber optic cable includes individual fiber optic cables attached to the individual shaped charges.

5. The system of claim 1, wherein the at least one fiber optic cable is a single fiber optic cable extending from the laser source to an optical component of the perforating gun.

6. The system of claim 5, wherein the optical component of the perforating gun comprises a rotational reflector or a splitter.

7. A system for forming perforations in a wellbore, the system comprising:

a laser source operable to generate a laser beam;

a perforating gun with shaped charges of at least two different sizes, the perforating gun controllably rotatable relative to the wellbore when deployed; and a cable extending between the laser source and the perforating gun, the cable including at least one fiber optic cable to carry the laser beam from the laser source to the perforating gun;

wherein each shaped charge comprises an explosive and a material that heats up to at least 888° C. within 3 seconds when contacted with a laser beam.

8. The system of claim 7, wherein the shaped charges of at least two different sizes comprise four shaped charges of different sizes.

9. The system of claim 8, wherein the shaped charges of at least two different sizes comprise stacked arrays, each array comprising four shaped charges of different sizes.

10. The system of claim 8, further comprising a gear, motor, and/or rotational joint operable to rotate the perforating gun when deployed.

11. The system of claim 7, wherein the at least one fiber optic cable includes individual fiber optic cables attached to the individual shaped charges.

12. The system of claim 7, wherein the at least one fiber optic cable is a single fiber optic cable extending from the laser source to an optical component of the perforating gun.

13. A method of forming perforations in a wellbore in a subsurface formation, the method comprising:

running a perforating gun into the wellbore;

operating a laser source to discharge a laser beam to the perforating gun to trigger a first shaped charge of the perforating gun to form a hole extending into the subsurface formation;

rotating the perforating gun in the wellbore to orient a second shaped charge of the perforating gun with the hole extending into the subsurface formation; and operating the laser source to discharge a laser beam to the perforating gun to trigger a second shaped charge of the perforating gun to extend the hole extending into the subsurface formation.

14. The method of claim 13, wherein running the perforating gun into the wellbore comprises running the perforating gun into the wellbore on a cable comprising at least one fiber optic cable.

15. The method of claim 14, wherein operating the laser source to discharge the laser beam to the perforating gun to trigger the first shaped charge comprises discharging the laser beam into the at least one fiber optic cable.

16. The method of claim 15, wherein the at least one fiber optic cable includes individual fiber optic cables attached to the individual shaped charges.

17. The method of claim 15, wherein the at least one fiber optic cable is a single fiber optic cable extending from the laser source to an optical component of the perforating gun.

18. The method of claim 17, wherein the optical component of the perforating gun comprises a rotational reflector or a splitter.

19. The method of claim 13, wherein the second shaped charge is smaller than the first shaped charge.

* * * * *